US010548420B2

(12) United States Patent
Cubbler

(10) Patent No.: US 10,548,420 B2
(45) Date of Patent: Feb. 4, 2020

(54) MULTI-LAYERED PILLOWCASE AND METHODS FOR MAKING THE SAME

(71) Applicant: Scott Ralston Cubbler, Houston, TX (US)

(72) Inventor: Scott Ralston Cubbler, Houston, TX (US)

( * ) Notice: Subject to any disclaimer, the term of this patent is extended or adjusted under 35 U.S.C. 154(b) by 0 days.

(21) Appl. No.: 15/978,385

(22) Filed: May 14, 2018

(65) Prior Publication Data

US 2019/0343305 A1 Nov. 14, 2019

(51) Int. Cl.
*A47G 9/02* (2006.01)
*A47C 31/00* (2006.01)

(52) U.S. Cl.
CPC ..... *A47G 9/0253* (2013.01); *A47G 9/0238* (2013.01); *A47C 31/007* (2013.01)

(58) Field of Classification Search
CPC ..... A47G 9/10; A47G 9/0253; A47G 9/0238; A47G 2009/001; A47G 9/007; A47C 7/383; A47C 7/38; A47C 31/007
USPC ..... 5/490, 482, 636, 641, 939
See application file for complete search history.

(56) References Cited

U.S. PATENT DOCUMENTS 4,864,669 A * 9/1989 Jones ..... A47G 9/0253 5/636
5,321,861 A * 6/1994 Dancey ..... A47C 27/007 5/482
6,256,816 B1 * 7/2001 Law ..... A47G 9/0207 5/482
7,089,617 B1 * 8/2006 Lauro ..... A47G 9/0253 5/490
7,243,385 B2 7/2007 Lampkins
8,978,178 B2 * 3/2015 Batiste ..... A47G 9/007 5/421
9,009,889 B1 * 4/2015 Cohen ..... A47G 9/0253 5/482
D728,271 S * 5/2015 Cohen ..... D6/601
9,155,408 B2 10/2015 Alletto, Jr.
9,247,836 B2 2/2016 DuPre
9,462,902 B1 * 10/2016 Rukel ..... A47G 9/10
2005/0229316 A1 * 10/2005 Liao ..... A47G 9/1045 5/639
2009/0083908 A1 * 4/2009 Fry ..... A47G 9/0253 5/636
2009/0188043 A1 * 7/2009 Kirch ..... A47G 9/10 5/643
2012/0227185 A1 * 9/2012 Batiste ..... A47G 9/007 5/641
2013/0042410 A1 * 2/2013 Bice ..... A47G 9/007 5/490
2015/0201765 A1 * 7/2015 Batiste ..... A47G 9/007 5/636
2019/0290033 A1 * 9/2019 Lonstein ..... A47G 9/10

* cited by examiner

*Primary Examiner* — Robert G Santos
(74) *Attorney, Agent, or Firm* — South Texas College of Law Houston

(57) ABSTRACT

Multi-layered pillowcases and methods of making and using the same are discussed herein. The multi-layered pillowcase generally includes an outer pillowcase and an inner pillowcase, wherein the inner pillowcase is smaller in total size than the outer pillowcase so as to allow the inner pillowcase to float inside the outer pillowcase and wherein the inner pillowcase is secured to the outer pillowcase.

14 Claims, 1 Drawing Sheet

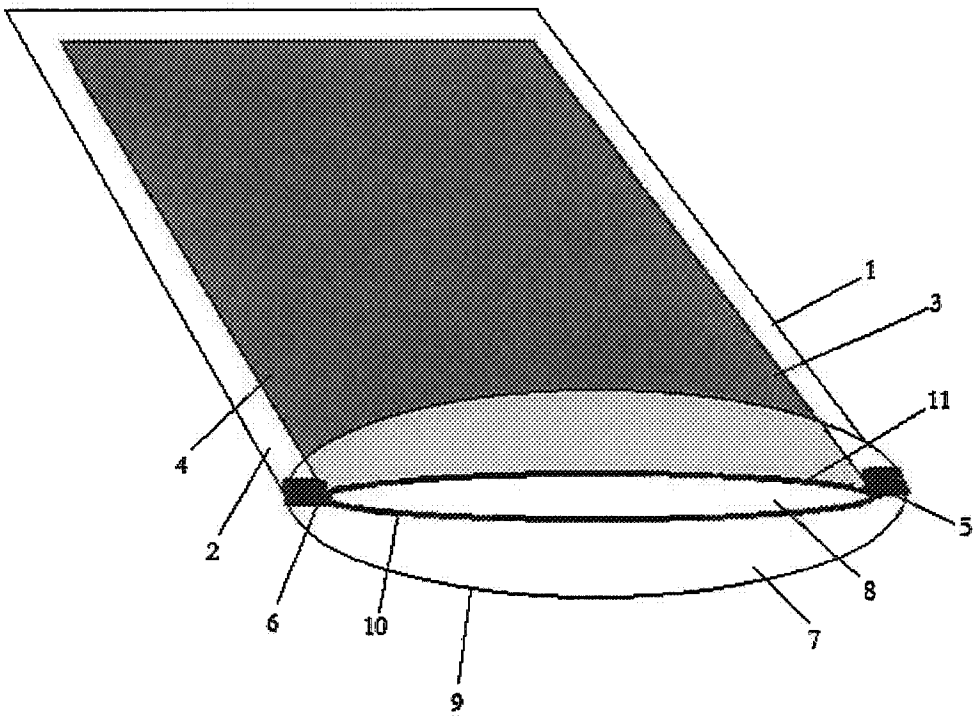
1
3
11
5
8
7
9
10
6
2
4

MULTI-LAYERED PILLOWCASE AND METHODS FOR MAKING THE SAME

CROSS-REFERENCE TO RELATED APPLICATIONS

N/A.

FIELD

Embodiments generally relate to devices and methods to prevent inhalation or contact with germs, viruses, body fluids, and other blood-borne pathogens on pillows.

BACKGROUND

When a person stays overnight, be it in a hotel, hospital room, or other accommodation, they usually have a pillow provided to them. Often times, it is difficult for the person to bring their own pillow as a tradeoff would occur where they may have to sacrifice other items due to baggage constraints on airlines, room in a car, etc. As such, people will often use the pillow that is provided.

While proprietors of these overnight accommodations claim that they routinely change the pillowcase, often the pillow itself will not be changed. Therefore, while the person's head will not necessarily come into contact with the same pillowcase that a previous person used, their head is resting on the same pillow. If the previous user had a cold and during the night, coughed or sneezed into the pillowcase, germs or viruses may imbed themselves into the pillow as pillowcases are often made of materials that do not block the passage of germs, viruses, body fluids and other blood-borne pathogens. Prior attempts to address the issue of protecting people from potential hazards from sleeping on these pillows have not specifically addressed the issue of blocking the passage of germs, viruses, body fluids and other blood-borne pathogens from the pillow to the person. Additionally, prior attempts did not address the need to use comfortable materials that come into contact with the persons head. Finally, prior attempts have not been designed for the specific needs of a traveler, who must be able to easily pack the pillowcase in their luggage as well as not confusing the pillowcase with the other provided pillowcases.

Therefore, a need exists to provide a comfortable pillowcase that is distinguishable from the typical pillowcase found in these types of accommodations that blocks germs, viruses, body fluids and other blood-borne pathogens.

SUMMARY

Embodiments generally include a multi-layered pillowcase. The multi-layered pillowcase generally includes an outer pillowcase and an inner pillowcase, wherein the inner pillowcase is smaller in total size than the outer pillowcase so as to allow the inner pillowcase to float inside the outer pillowcase and wherein the inner pillowcase is secured to the outer pillowcase.

One or more embodiments include the pillowcase of the preceding paragraph, wherein the outer pillowcase is made of a first material that is selected from cotton, polyester, silk, or a combination thereof.

One or more embodiments include the pillowcase of any preceding paragraph, wherein the inner pillowcase is made of a second material, wherein the second material is anti-microbial and adapted to block the flow of germs, viruses, body fluids and other blood-borne pathogens therethrough.

One or more embodiments include the pillowcase of any preceding paragraph, wherein the inner pillowcase is made of a second material, wherein the second material is water-resistant and exhibits a moisture vapor transmission rate from 0.1 and 30 g/m$^2$ day, as measured by ASTM 2298.

One or more embodiments include the pillowcase of any preceding paragraph, wherein the inner pillowcase is secured to the outer pillowcase.

One or more embodiments include the pillowcase of any preceding paragraph, wherein the inner pillowcase is sealed via a zipper, a plurality of buttons, or a plurality of snaps.

One or more embodiments include a multi-layered pillowcase including a first panel; a second panel perimetrically joined with the first panel so that an inner surface of each of the first and second panels define a cavity having a void volume and one opening; a third panel perimetrically joined with a fourth panel so that the inner surface of the third and fourth panels define a cavity having a void volume and one opening, the perimetrically joined third and fourth panel connected to the perimetrically joined first and second panels along the opening such that the perimetrically joined third and fourth panel floats between the perimetrically joined first and second panels, wherein the perimetrically joined third and fourth panels are connected by a fastening mechanism adapted to seal the opening, wherein the first and second materials are formed of a first material and the third and fourth panels are formed of a second material, the second material being different from the first material, and wherein the perimetrically joined third and fourth panel are secured to the perimetrically joined first and second panels.

One or more embodiments include the pillowcase of any preceding paragraph, wherein the perimetrically joined third and fourth panels allows for a pillow to be inserted and sealed via a fastening mechanism.

One or more embodiments include the pillowcase of any preceding paragraph, wherein the fastening mechanism includes a zipper, a plurality of buttons, or a plurality of snaps.

One or more embodiments include the pillowcase of any preceding paragraph, wherein the void volume of the perimetrically joined first and second panels allows for a pillow to be inserted between the void of the perimetrically joined third and fourth panels, causing the multi-layered pillowcase to create two layers over a pillow.

One or more embodiments include the pillowcase of any preceding paragraph, wherein the first material is selected from cotton, polyester, silk and combinations thereof.

One or more embodiments include the pillowcase of any preceding paragraph, wherein the second material is an anti-microbial material.

One or more embodiments include the pillowcase of any preceding paragraph, wherein the second material has a moisture vapor transmission rate from 0.1 and 30 g/m$^2$ day, as measured by ASTM 2298.

One or more embodiments include a method of forming a pillowcase including forming an outer pillowcase of a first material, the first material selected for comfort of a user, forming an inner pillowcase of a second material, the second material exhibiting anti-microbial properties; and securing the inner and outer pillowcases to one another such that the outer pillowcase forms an exterior surface and the inner pillowcase forms a void volume adapted for receipt of fill.

One or more embodiments include the pillowcase of any preceding paragraph, wherein the inner pillowcase is adapted to receive a standard queen, king, super standard, or European sized pillow.

BRIEF DESCRIPTION OF DRAWINGS

FIG. 1 illustrates the cross-sectional view of the multi-layered pillowcase.

DETAILED DESCRIPTION

Introduction and Definitions

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions when the information in this patent is combined with available information and technology.

Various terms as used herein are shown below. To the extent a term used in a claim is not defined below, it should be given the broadest definition skilled persons in the pertinent art have given that term as reflected in printed publications and issued patents at the time of filing. Further, unless otherwise specified, all compounds described herein may be substituted or unsubstituted and the listing of compounds includes derivatives thereof.

Further, various ranges and/or numerical limitations may be expressly stated below. It should be recognized that unless stated otherwise, it is intended that endpoints are to be interchangeable. Further, any ranges include iterative ranges of like magnitude falling within the expressly stated ranges or limitations.

Embodiments described herein generally include multi-layered pillowcases and methods of forming the same.

The multi-layered pillowcase is described herein. The multi-layered pillowcase generally contains an outer pillowcase and an inner pillowcase. The inner pillowcase is smaller than the outer pillowcase so as to allow the inner pillowcase to float inside the outer pillowcase. The inner pillowcase may be secured to the outer pillowcase. The inner pillowcase may be sealable.

The outer pillowcase may be formed of a first material, such as, for example, a breathable fabric. The term "breathable fabric" means any material that allows for the flow of air. The breathable fabric, may include cotton, polyester, silk or a combination thereof.

The inner pillowcase will be made from a second material, such as, for example, an anti-microbial, water-resistant material. The term "anti-microbial" will be material that is capable of blocking the flow of germs, viruses, body fluids and other blood-borne pathogens. The term "water-resistant" will be material that has a moister vapor transmission rate ("MVTR") from 0.1 and 30 g/m$^2$ day, or 0.5 to 25 g/m$^2$ day, or 1 to 20 g/m$^2$ day, for example as measured by ASTM 2298. The inner pillowcase may be sealed via a fastening mechanism. The term "fastening mechanism" may be a zipper, a plurality of buttons or a plurality of snaps.

The method for making the multi-layered pillowcase is described herein. The multi-layered pillowcase generally contains a first and second rectangular panel, made of a first material, joined together perimetrically, which will herein be referred to as the outer pillowcase. As used herein, the term "perimetrically" means that one panel will be placed on top of the other panel so that they look as though they are one single panel. As used herein, the term "joined" will mean that the two panels will be sewn together along their perimeters with the exception of one of the shorter ends of the rectangular panel, which will not be sewn together. A third and fourth panel, made of a second material, will be perimetrically joined together, which will herein be referred to as the inner pillowcase. The inner pillowcase is smaller than the outer pillowcase so as to allow the inner pillowcase to float between the first and second panels making up the outer pillowcase. The inner pillowcase may be secured to the outer pillowcase via a securing mechanism. The term "securing mechanism" means any mechanism that will secure the inner pillowcase to the outer pillowcase in such a way that they will be connected. A preferred embodiment will be for the inner pillowcase to be sewn on to the outer pillowcase along both of their openings.

The method for using the multi-layered pillowcase is described herein. The multi-layered pillowcase may be used by people who are traveling and staying overnight in hotels, motels, and other temporary, overnight accommodations. In addition, the multi-layered pillowcase may be used by people staying overnight in hospital beds. As such, the inner pillowcase may be designed to insert a standard queen, king, or super standard pillowcase inside it. Additionally, the inner pillowcase may also be designed to insert any type of international pillows inside it, for example, a European pillow. The outer pillowcase may be any color as to ensure that users will not confuse it with any pillowcases that are provided for by the hotel, motel, hospital, or other temporary, overnight accommodation. In addition, the outer pillowcase may also contain various designs that the user selects, such as the logo of their favorite sports team, college affiliation, corporation or inspirational sayings to further ensure that they will not mistake it for any pillowcases that are provided for by the hotel, motel, hospital, or other temporary, overnight accommodation.

An embodiment of a multi-layered pillowcase is illustrated in FIG. 1. The multi-layered pillowcase 100 includes a first panel 1 and a second panel 2 perimetrically joined with the first panel 1 such that inner surface 7 of first and second panels 1, 2 define a cavity having a void volume and at least one opening 9. A third panel 3 and a fourth panel 4 are perimetrically joined with the third panel 3 such that inner surface 8 of third and fourth panels 3, 4 define a cavity having a void volume and at least one opening 10. First and second panels 1, 2 each have a rectangular cross-sectional configuration such that cavity 7 has a size and shape that is larger than a fill pillow. Third and fourth panels 3, 4 each have a rectangular cross-sectional configuration such that cavity 8 has a size and shape that conforms to that of a fill pillow. The third and fourth panels 3, 4 are adapted for securing to the first and second panels 1, 2 at points 5 and 6. The opening formed by the third and fourth panel 10 will be sealed via the fastening mechanism 11.

While the foregoing is directed to embodiments of the present invention, other and further embodiments of the invention may be devised without departing from the basic scope thereof and the scope thereof is determined by the claims that follow.

What is claimed is:

1. A multi-layered pillowcase comprising:

an outer pillowcase comprising a first opening; and an inner pillowcase comprising a second opening;

wherein the inner pillowcase is smaller in total size than the outer pillowcase so as to allow the inner pillowcase to float inside the outer pillowcase and wherein opposite sides of the first opening of the outer pillowcase are secured to opposite sides of the second opening of the inner pillowcase.

2. The multi-layered pillowcase of claim 1, wherein the outer pillowcase is made of a first material that is selected from cotton, polyester, silk, or a combination thereof.

3. The multi-layered pillowcase of claim 1, wherein the inner pillowcase is made of a second material, wherein the second material is anti-microbial and adapted to block the flow of germs, viruses, body fluids and other blood-borne pathogens therethrough.

4. The multi-layered pillowcase of claim 1, wherein the inner pillowcase is made of a second material, wherein the second material is water-resistant and exhibits a moisture vapor transmission rate from 0.1 and 30 $g/m^2$ day, as measured by ASTM 2298.

5. The multi-layered pillowcase of claim 1, wherein the inner pillowcase is sealed via a zipper, a plurality of buttons, or a plurality of snaps.

6. The multi-layered pillowcase of claim 1, wherein the inner pillowcase is adapted to receive a standard queen, king, super standard, or European sized pillow.

7. A multi-layered pillowcase comprising:

a first panel;

a second panel perimetrically joined with the first panel so that an inner surface of each of the first and second panels define a cavity having a void volume and a first opening; and a third panel perimetrically joined with a fourth panel so that the inner surface of the third and fourth panels define a cavity having a void volume and a second opening, the perimetrically joined third and fourth panels connected to the perimetrically joined first and second panels at respective opposite sides of the first and second openings such that the perimetrically joined third and fourth panels float between the perimetrically joined first and second panels, wherein the perimetrically joined third and fourth panels are connected by a fastening mechanism adapted to seal the second opening, wherein the first and second panels are formed of a first material and the third and fourth panels are formed of a second material, the second material being different from the first material.

8. The multi-layered pillowcase of claim 7, wherein the perimetrically joined third and fourth panels allows for a pillow to be inserted and sealed via the fastening mechanism.

9. The pillowcase of claim 7, wherein the fastening mechanism comprises a zipper, a plurality of buttons, or a plurality of snaps.

10. The multi-layered pillowcase of claim 7, wherein the void volume of the perimetrically joined first and second panels allows for a pillow to be inserted within the void volume of the perimetrically joined third and fourth panels, causing the multi-layered pillowcase to create two layers over a pillow.

11. The multi-layered pillowcase of claim 7, wherein the first material is selected from cotton, polyester, silk and combinations thereof.

12. The multi-layered pillowcase of claim 7, wherein the second material is an anti-microbial material.

13. The multi-layered pillowcase of claim 7, wherein the second material has a moisture vapor transmission rate from 0.1 and 30 $g/m^2$ day, as measured by ASTM 2298.

14. A method of forming a pillowcase, comprising:

forming an outer pillowcase of a first material having a first opening, the first material selected for comfort of a user;

forming an inner pillowcase of a second material having a second opening, the second material exhibiting anti-microbial properties; and securing the first and second openings of the inner and outer pillowcases to one another, at respective opposite sides, such that the outer pillowcase forms an exterior surface and the inner pillowcase floats inside the outer pillowcase and forms a void volume adapted for receipt of fill.

* * * * *